US009540223B2

(12) United States Patent
Vandekerckhove et al.

(10) Patent No.: US 9,540,223 B2
(45) Date of Patent: Jan. 10, 2017

(54) DISPENSING APPLIANCE PROVIDED WITH MEANS FOR POSITIONING A CONTAINER

(75) Inventors: Stijn Vandekerckhove, Brussels (BE); Daniel Peirsman, Brussels (BE)

(73) Assignee: Anheuser-Busch InBev S.A., Brussels (BE)

( * ) Notice: Subject to any disclaimer, the term of this patent is extended or adjusted under 35 U.S.C. 154(b) by 187 days.

(21) Appl. No.: 13/882,490

(22) PCT Filed: Oct. 28, 2011

(86) PCT No.: PCT/EP2011/069035

§ 371 (c)(1),
(2), (4) Date: May 2, 2013

(87) PCT Pub. No.: WO2012/056017

PCT Pub. Date: May 3, 2012

(65) Prior Publication Data

US 2013/0221029 A1 Aug. 29, 2013

(30) Foreign Application Priority Data

Oct. 29, 2010 (EP) ..... 10189448

(51) Int. Cl.
*B67D 1/00* (2006.01)
*B67D 1/04* (2006.01)
*B67D 3/00* (2006.01)

(52) U.S. Cl.
CPC ..... *B67D 1/0412* (2013.01); *B67D 1/04* (2013.01); *B67D 3/0032* (2013.01)

(58) Field of Classification Search
CPC ... B67D 1/0412; B67D 1/0808; B67D 1/0829; B67D 1/0845; B67D 7/344; B67D 7/28; B67D 1/04; B67D 3/0032
(Continued)

(56) References Cited

U.S. PATENT DOCUMENTS 3,374,927 A 3/1968 Schmidt
4,501,383 A * 2/1985 Iannelli ..... B67B 7/28 222/131

(Continued)

FOREIGN PATENT DOCUMENTS

| | | |
|---|---|---|
| EP | 0 395 197 | 10/1990 |
| EP | 0 523 915 | 1/1993 |
| EP | 1 122 078 | 8/2001 |
| EP | 1 647 499 | 4/2006 |
| EP | 2 146 832 | 10/2008 |
| EP | 2 148 770 | 10/2008 |
| EP | 2 148 771 | 10/2008 |

(Continued)

OTHER PUBLICATIONS http:/en.wikipedia.org/wiki/Centroid.

*Primary Examiner* — Patrick M Buechner
(74) *Attorney, Agent, or Firm* — Levy & Grandinetti

(57) ABSTRACT

A pressure dispensing container containing a liquid and closed by a closure having a first aperture offset with respect to the centroid of the closure's base is disclosed. The container is mounted on a dispensing appliance including a first tube to be inserted into the corresponding first, offset aperture of the closure. The closure further having a crenellation in its lower rim mating a crenellation in a structure for receiving the closure of the container. A closure holding structure is located in the holding portion of the appliance and is suitable for receiving in mating relationship the closure of the container such that the first offset aperture of the closure is in direct engaging relationship with the first tube of the appliance.

8 Claims, 3 Drawing Sheets

(58) Field of Classification Search
USPC ..... 222/85, 400.7
See application file for complete search history.

(56) References Cited

U.S. PATENT DOCUMENTS

| | | | | |
|---|---|---|---|---|
| 4,726,494 | A * | 2/1988 | Scott | B67D 1/04 222/129.3 |
| 5,102,010 | A * | 4/1992 | Osgar et al. | 222/1 |
| 5,248,064 | A | 9/1993 | Claycomb, Jr. | |
| 5,251,787 | A | 10/1993 | Simson | |
| 5,431,309 | A | 7/1995 | Ophardt | |
| 5,499,758 | A | 3/1996 | McCann et al. | |
| 6,206,240 | B1 * | 3/2001 | Osgar et al. | 222/39 |
| 6,450,214 | B1 * | 9/2002 | Dyer et al. | 141/9 |
| 6,607,105 | B2 | 8/2003 | Phelps et al. | |
| 2009/0057347 | A1 * | 3/2009 | Leys et al. | 222/386.5 |
| 2009/0242562 | A1 | 10/2009 | Valderrama et al. | |

FOREIGN PATENT DOCUMENTS

| | | |
|---|---|---|
| EP | 2 152 486 | 10/2008 |
| EP | 2 152 494 | 10/2008 |
| EP | 2 165 968 | 3/2010 |
| FR | 2 602 222 | 2/1988 |
| GB | 1 438 228 | 6/1976 |
| GB | 2 202 836 | 10/1988 |
| GB | 2 237 844 | 5/1991 |
| GB | 2 299 806 | 10/1996 |
| WO | WO 90/15774 | 12/1990 |
| WO | WO 02/081316 | 10/2002 |
| WO | WO 2007/061967 | 5/2007 |
| WO | WO 2008/055929 | 5/2008 |
| WO | WO 2008/129018 | 10/2008 |
| WO | WO 2009/013173 | 1/2009 |
| WO | WO 2010/055057 | 5/2010 |

* cited by examiner

DISPENSING APPLIANCE PROVIDED WITH MEANS FOR POSITIONING A CONTAINER

This Application is the U.S. National Phase of International Application Number PCT/EP2011/069035 filed on Oct. 28, 2011, which claims priority to European Application Number 10189448.3 filed on Oct. 29, 2010.

TECHNICAL FIELD

The present invention relates to a dispensing assembly of a container containing a fluid and a dispensing appliance, wherein the angular orientation of the container about its axial direction when mounted on the dispensing appliance is essential to the functioning of the assembly. In particular, this situation occurs with containers comprising a closure provided with an offset opening with respect to the centroid of the closure's base, such as for closures having at least two openings to be connected to corresponding tubing of the appliance. The assembly of the present invention is particularly suitable for dispensing beverages, such as wine, and more particularly carbonated beverages such as beers and sodas.

BACKGROUND OF THE INVENTION

Many dispensing containers rely for the dispensing of the liquid contained therein, on a dispensing tube and a gas connection. The dispensing tube permits the liquid contained in the container to flow out thereof, driven by a pressure difference between the interior and the exterior of the container. Said pressure difference may be created by gravity if the closure is located below the liquid level, by an overpressure inside the container, or by vacuum at the outlet of the dispensing tube. The gas connection may serve either to inject pressurized gas into the container to drive the dispensing of liquid, or to allow air into the container to fill the volume of dispensed liquid such as to maintain the pressure relatively constant in the container. The container may comprise a single wall (although the wall can be a laminate) or may comprise several detachable layers, such as in bag-in-containers and bladder-in-containers. Bag-in-containers, also referred to as bag-in-bottles or bag-in-boxes depending on the geometry of the outer vessel, all terms considered herein as being comprised within the meaning of the term bag-in-container, are a family of liquid dispensing packaging consisting of an outer container comprising an opening to the atmosphere—the mouth—and which contains a collapsible inner bag joined to said container and opening to the atmosphere at the region of said mouth. The liquid is contained in the inner bag. The system must comprise at least one vent fluidly connecting the atmosphere to the region between the inner bag and the outer container in order to control the pressure in said region to squeeze the inner bag and thus dispense the liquid contained therein (cf. e.g., WO2008/129018 and GB8925324). Alternatively, in bladder-in-containers, the liquid is contained in the outer container and the inner bag, generally called a bladder, is either inflated to drive the flow of liquid out of the container, or simply put in fluid connection with atmospheric, in order to balance the pressure inside the container (cf. WO9015774, EP1647499, WO2010055057, U.S. Pat. No. 5,499,758, GB9504284, FR2602222, GB8806378). The advantage of bag-in-containers and bladder-in-containers over single wall containers is that the liquid is never in contact with an external gas. The present invention applies to any type of such containers.

The dispensing tube and gas connections often communicate with the interior of the container through the closure thereof, which is therefore provided with at least two openings. Unless the two openings are concentric, the closure is not axisymmetrical. This is one example among others where the position of at least one aperture of the closure is offset with respect to the centroid of the base plane of the closure, wherein the centroid of a geometrical shape corresponds to the centre of gravity of said shape having a uniform density and thickness (cf. e.g., http://en.wikipedia.org/wiki/Centroid).

Some dispensing containers are stand alone, and can be used as such. In some cases, however, the container must be mounted on a dispensing appliance to function properly. The appliance comprises a first portion for holding the container in dispensing position, and a second portion provided with means for creating a fluid communication between the interior of the container and a dispensing tube and a gas connection through the closure of the container. The container may be positioned with the closure located below the level of liquid to drive the flow out of the container by way of gravity, as is the case in many soap dispensers. Soap dispensers, however, rarely require a closure with two openings. Examples of such soap dispensers can be found in U.S. Pat. No. 5,431,309 and WO200761967.

US2009/0242562 discloses a closure comprising a seal indicator providing indication when seal has been achieved between the closure and a container upon relative rotational movement over mating threads, GB1438228. This type of closure is not meant to be used with pressurized containers. GB1438228 discloses a closure unit comprising an overcap with a peripheral skirt and two sealing plugs comprising bores with puncturable membranes, the plugs being integrally moulded to each other and to a washer, thereby forming a gasket which becomes compressed against the lip of a pressurized beer barrel when the skirt is crimped under the lip. In particular, two tongues are crimped with a tool under the lip of the container. Neither the closure, nor the container it is coupled to have any orientation requirement to function properly, as the dispensing does not require to couple the container with closure to a dispensing appliance.

An example of an assembly of a container and a dispensing appliance is given in WO90/15774, wherein the container is a bladder-in-container. In WO90/15774, a dispending end section of the housing is provided with a bladder and a dispensing stem, running through a threaded opening in said end suitable for screwing the container's mouth into position. The bladder and dispensing stem provided in the dispensing end of the appliance are therefore first introduced and fixed into the container, and thereafter the dispensing end and container are positioned in the housing of the appliance. A similar system can be found in U.S. Pat. No. 5,251,787 with a bag-in-container, wherein a dispensing end of the appliance comprises a dispensing stem to be introduced into the bag containing the liquid. Applying a dispensing end of a dispensing appliance with a stem into a container is quite cumbersome and has the great drawback that the container must be opened before mounting on the appliance. This contact of the liquid with ambient may be critical for the quality of some liquids.

For comfort of use, it is preferred that the container may be mounted onto the dispensing appliance in as few moves as possible, and for sensitive liquids, avoiding any contact between the liquid contained in the container with ambient. The latter can be achieved by providing the dispensing tube and gas connection with puncturing means suitable for breaking open a sealed opening. To reduce the number of moves required to mount the container onto the dispensing appliance, one could imagine that the container may be mounted onto the holding portion of an appliance and the dispensing end thereof simply applied on against the closure, with the aim of bringing the interior of the container in fluid communication with a dispensing tube and a gas connection. Now in case the closure is not axisymmetrical because of the presence of at least one offset opening, as is the case with at least two, non concentric openings, the angular position of the container in its axial direction becomes critical, because the dispensing tube and gas connection must be brought in perfect match with the position of the corresponding openings. This is particularly critical when puncturing means are used as forcing the puncturing means against a closure having a wrong angular orientation could damage either the closure or the puncturing means. The user must therefore look carefully that the angular orientation of the container in the holding portion of the appliance is correct before closing the dispensing end of the appliance onto the closure, which is probably more uncomfortable than the solutions proposed in WO90/15774 and U.S. Pat. No. 5,251,787 discussed above.

It is therefore an object of the present invention to provide an assembly considerably simplifying the mounting of a container onto a dispensing appliance comprising at least one duct to be connected in as few moves as possible to an opening provided on the base of a closure, when said opening is offset with respect of the centroid of said closure's base. It is also an object of the present invention to provide such system wherein said mounting does not necessitate contacting the liquid contained in the container with ambient. These and other objects of the invention are presented hereinbelow.

SUMMARY OF THE INVENTION

The present invention is defined in the appended independent claims. Preferred embodiments are defined in the dependent claims. In particular, the present invention concerns a closure for closing the aperture of a pressure driven dispensing container, said closure comprising an outer shell comprising:

(a) a substantially planar base comprising a first outer main surface and a second inner main surface separated from the outer surface by the thickness of the base, said base further comprising a first aperture fluidly connecting the outer surface to the inner surface, and being offset with respect to the centroid of the base, and (b) an outer peripheral skirt jutting out of the periphery of the inner surface and forming a lower rim, said peripheral skirt being suitable for enclosing and for sealingly fixing the closure to the aperture of said pressure driven dispensing container;

wherein, the lower rim of the closure comprises a crenellation comprising at least one crenel.

It is particularly preferred if the closure defined above further comprises a second aperture fluidly connecting the outer surface to the inner surface, and being suitable for receiving a dispensing tube, The crenellation of the lower rim preferably comprises at least two crenels separated by at least one merlon. The crenellation of the closure preferably has a height comprised between 1 and 20 mm, preferably between 1.5 and 10 mm, more preferably between 2 and 4 mm. The height of the crenellation corresponds to the longest distance separating the lower rim from the top of the crenels. The width in the circumferential direction of any crenel is preferably comprised between 1.5 and 20 mm, more preferably between 2 and 10 mm, most preferably between 4 and 8 mm and the width of any merlon (18B), if any, is preferably comprised between 3 and 15 mm, more preferably between 5 and 10 mm.

In an advantageous embodiment, the at least one merlon is provided with a bar code or any other means of information, comprising information related to the container and/or the liquid contained therein.

The present invention also concerns a container comprising a body, a neck, a mouth, and a closure as defined above closing said mouth. The container is preferably substantially axisymmetrical. In an advantageous embodiment, the container is a bag-in-container.

The present invention also concerns a dispensing appliance suitable for receiving a pressure driven dispensing container as defined above and for dispensing a liquid contained in said container, said dispensing appliance comprising:

(a) a holding portion comprising means for holding the body of said container and means suitable for receiving the closure of the container, and (b) a dispensing portion comprising a first tube suitable for engaging into said first offset opening of the closure, in fluid communication with the interior of the container, said dispensing portion being movingly connected to the holding portion to move from a first, loading position, allowing the loading of the container onto the appliance, and a second, dispensing position, allowing the dispensing of the liquid contained in the container, wherein the closure supporting means comprise a crenellation comprising at least one merlon mating the crenellation of the closure.

In an preferred embodiment of the present invention the dispensing portion of the appliance further comprises a second tube suitable for engaging into a second opening of a closure as defined above with at least two openings, to bring the interior of the container in fluid communication with ambient, whilst the first, offset tube is suitable for connecting the interior of the container to a source of pressurized gas. The first and, in particular, the second tubes of the appliance preferably comprise a valve for controlling the flow of fluid therethrough.

It is further preferred that the crenellation of the closure receiving means of the appliance comprises at least two merlons separated by a crenel. Said crenel could then advantageously be provided with a switch, which pressing closes an electrical circuit allowing the supply of power to the appliance, and/or with means for reading a bar code, which are connected to display means for displaying at least part of the information conveyed in a bar code located in a merlon of the closure of the container, said merlon mating the crenel (18A) of the closure receiving means.

The ends of the first tube and, if any, of the second tube should be sufficiently hard and sharp to penetrate into a respective first opening and second opening, if any, of the closure of a container when mounted onto the appliance, upon moving the dispensing portion of the appliance into its second, dispensing position. This is particularly true when at least one closure is sealed prior to use, and the seal must be pierced open by introducing a tube therethrough.

The present invention also concerns a dispensing assembly comprising:

(a) a container as discussed supra; and (b) a dispensing appliance as discussed supra, wherein, the crenellation of the closure receiving means of the appliance mates the crenellation of the closure of the container, such that when the crenellation of the closure is engaged in the crenellation of the receiving means, the first, offset opening, and the second opening, if any, of the closure are in direct engaging relationship with the first tube and second tube, if any, of the appliance.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
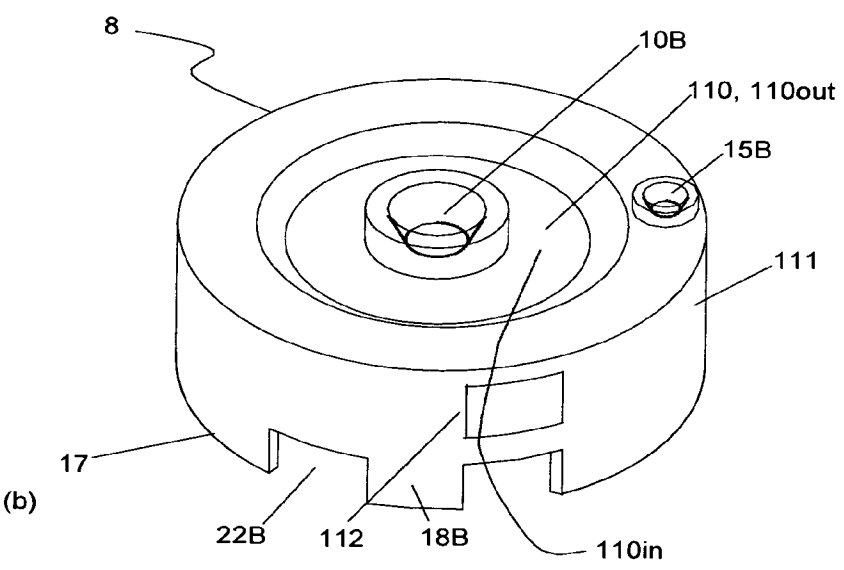
FIG. 1: shows two embodiments of a closure according to the present invention.
Figure 1:
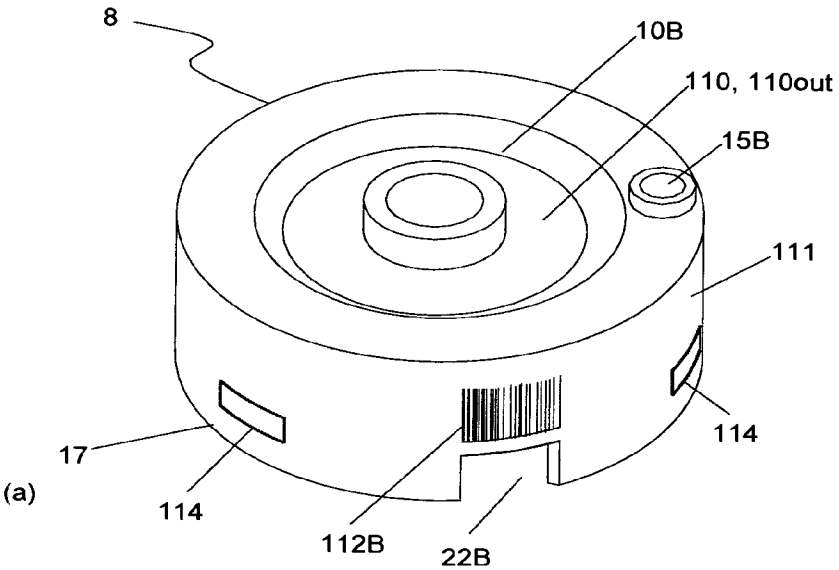
Figure 2:
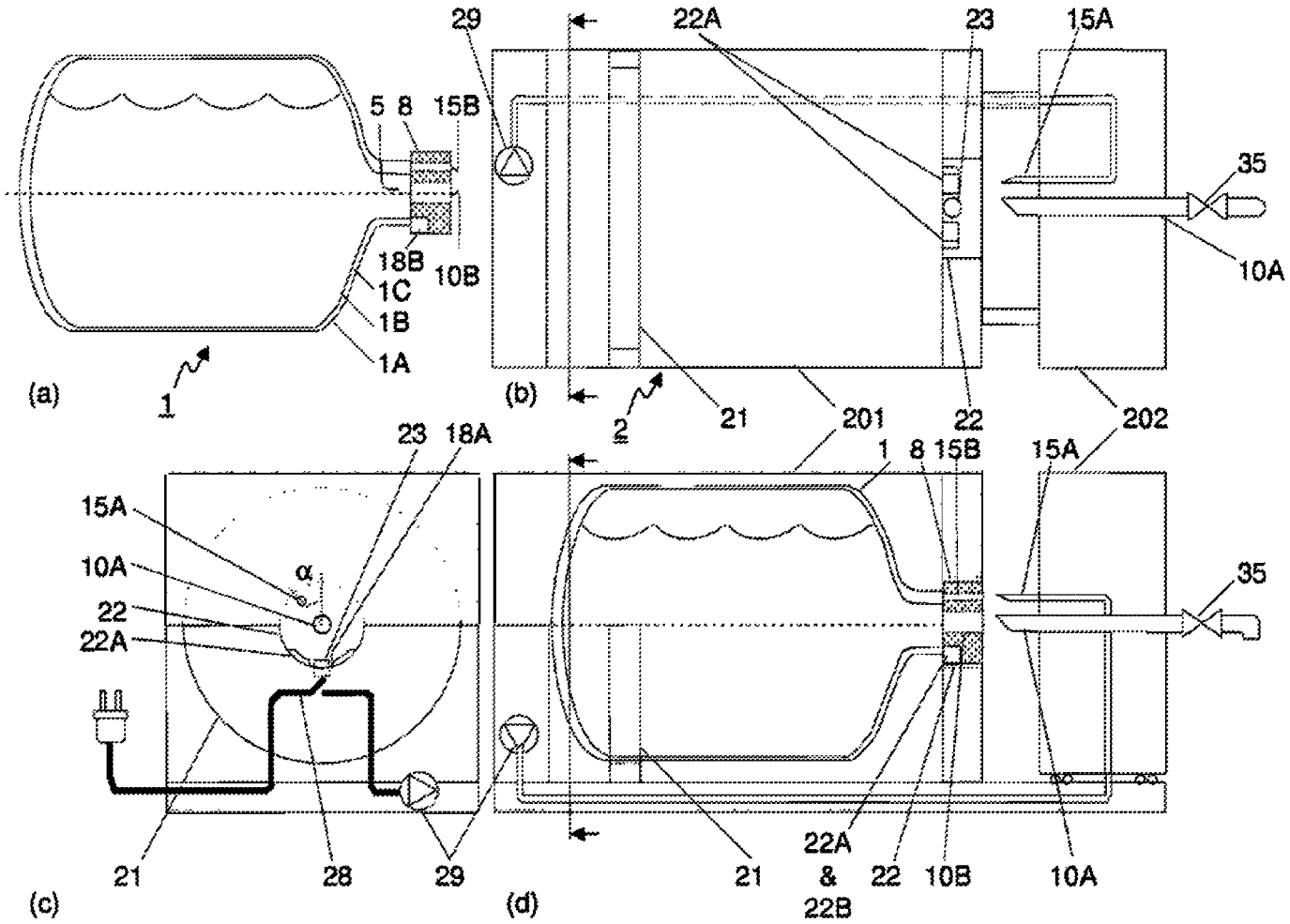
FIG. 2: shows (a) a container, and (b) top, (c) bottom, and (d) side views of a dispenser according to the present invention in a first, loading position.
Figure 3:
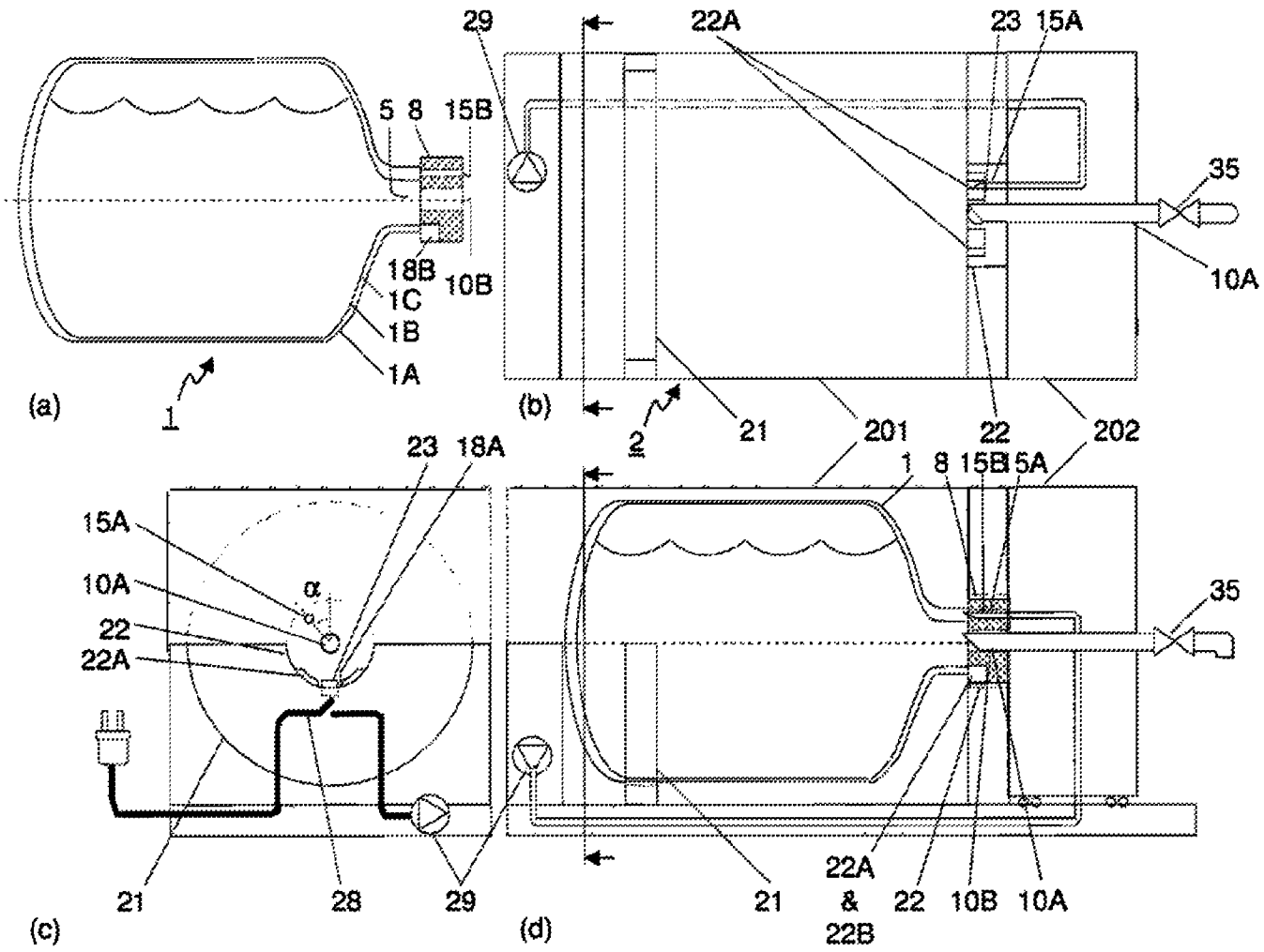
FIG. 3: shows (a) a container, and (b) top, (c) bottom, and (d) side views of a dispenser according to the present invention in a second, dispensing position.

The angular orientation, α, in the radial direction of the container upon mounting onto a dispensing appliance becomes critical as soon as there is at least one aperture (15B) which is offset with respect to the centroid of the base of the closure (8). Said offset aperture (15B) is not even necessarily located on the base of the closure, since it could be located on the skirt (111) thereof and thus be offset with respect to said centroid. The closure (8) may comprise one or more additional apertures (10B) which location is not limited. The embodiment of the closure (8) depicted in FIGS. 1 to 3 and discussed in continuation comprises two openings (10B, 15B). As illustrated in FIGS. 1 to 3, the first aperture (15B) is offset with respect to the centre of the circular base (110) of the closure and is suitable for being connected to a source of pressurized gas (29) through a gas tube (15A). The second aperture (10B) is centred with respect to the circular base (110) of the closure and is suitable for being connected to a dispensing tube (10A).

The closure depicted in FIG. 1 comprises an outer shell comprising a substantially planar base (110) comprising a first outer main surface (110out) and a second inner main surface (110in) separated from the outer surface by the thickness of the base, and an outer peripheral skirt (111) jutting out of the periphery of the inner surface (110in) and forming a lower rim (17), said peripheral skirt (111) being suitable for enclosing and for sealingly fixing the closure (8) to the aperture (5) of said pressure driven dispensing container. The closure illustrated in FIG. 1 further comprises

- a first, dispensing aperture (10B) fluidly connecting the outer surface (110out) to the inner surface (110in), and being suitable for receiving a dispensing tube (10A), and
- a second gas aperture (15B) fluidly connecting the outer surface (110out) to the inner surface (110in), and being suitable for receiving a gas tube (15A);

This type of closures is suitable for being mounted on pressure dispensing containers, which are herein defined as containers which dispensing is driven by creating a higher pressure in the interior of the container compared with the pressure in the exterior thereof. This can be done by injecting a pressurized gas into the container through the first aperture (15B), and the liquid contained therein is thus forced to flow out through the dispensing tube (10A). An alternative way is to create a vacuum in the dispensing tube which drives the flow of liquid out of the container, the first aperture (15B) being in fluid communication with ambient, to compensate the vacuum created in the container by the dispensing of the liquid. Although the closure of the present invention may be used in this latter embodiment, it is preferred to apply it to a pressure dispensing container driven by injection of a pressurized gas. In order to resist the inner pressure within the container, the closure is preferably coupled to the container with snap fitting means (114). The pressurized gas may be injected into the same volume that contains the liquid. The dispensing tube must then comprise a dispensing stem extending deep into the interior of the container (not shown in the Figures). The closure may comprise a sealing member (not shown in the Figures) enclosing both apertures (10B, 15B). Alternatively, the liquid may be contained in a flexible and collapsible bag (1B), and the pressurized gas is then injected into the interfacial space (1C) between the outer layer (1A) of the container and the flexible bag (1B). This solution, called bag-in-container and illustrated in FIGS. 2(*a*) and 3(*a*), has the advantage that the gas never contacts the liquid. Furthermore, no dispensing stem extending into the interior of the container is required for driving the liquid out through the dispensing tube (10A). As reviewed in the introductory section, in bladder-in-containers the liquid may be contained in an outer layer (1A), and gas is injected into a flexible bladder (1B). In the present invention, bag-in-containers are preferred to bladder-in-containers. For both bag-in-containers and bladder-in-containers, the closure may comprise two sealing members, a first sealing member enclosing one aperture, and the second sealing member enclosing both apertures (10B, 15B). The first and/or second aperture (15B, 10B) are preferably tapered in the direction of the skirt (111) (as shown in FIG. 1(*b*)) over at least part of the base thickness, in order to facilitate the introduction from the outside of a gas tube (15A) and/or a dispensing tube (10A), respectively.

With a first opening (15B) offset with respect to the centroid of the base of the closure, the closure cannot be axisymmetric. In particular for bag-in-containers, wherein the gas is injected trough a vent communicating with the interface (1C) between inner (1B) and outer (1A) layers of the bag-in-container and located at the edge of the container mouth (5), the gas opening (15B) of the closure is therefore often off-centred, whilst the dispensing opening may be centred. This geometry corresponds to the preferred embodiment represented in FIG. 1 but, as discussed above, other geometries are possible within the scope of the present invention. The problem with non-axisymmetric closures requiring a connection to at least one tube (15A) is that the angular orientation, a, about the axis of revolution of the container must be such that the position of the first, offset opening (15B) matches the position of the gas tube (15A) of the dispenser the container must be mounted on to function. Of course, as reviewed in the introductory section, the tubes may be connected one by one to the closure and the whole system mounted on a dispenser, but today's consumers' expectations go much beyond such lengthy and meticulous work and require a user friendly, fool proof, and simple system, requiring as little manipulation as possible and with a high degree of reliability and reproducibility. For this reason, the lower rim (17) of the closure according to the present invention is provided with a crenellation comprising at least one crenel (22B) as illustrated in FIG. 1(*a*). In a preferred embodiment, the crenellation of the lower rim (17) of the closure comprises at least two crenels (22B) separated by a merlon (18B).

The crenellation of the closure according to the present invention mates a crenellation provided in supporting means (22) of a dispensing appliance designed to receive and support the closure (8) of the container. In FIGS. 2 and 3 the closure receiving means (22) are represented as a substantially half cylindrical cradle (22), but any geometry allowing the interconnection of the crenellations of the closure (8) and the holding means (22) is possible. In its simplest form, a crenellation protruding out of a small flat surface is sufficient, provided the angular orientation, α, of the container (1) can be set by the two crenellations engaging in one another. By providing a mating set of crenellations in the closure (8) and the closure supporting means (22), the container (1) is necessarily mounted onto the dispensing appliance (2) with the correct angular orientation, a, for the dispensing tube (10A) and the gas tube (15A) of the appliance (2) to engage directly into the corresponding dispensing (10B) and gas (15B) apertures of the closure (8). The crenellation of the closure (8) represented in FIG. 1(*a*) comprises a single crenel (22B) and the one illustrated in FIG. 1(*b*) consists of one merlon (18B) separating two crenels (22B). It can be seen that the crenellation is obtained by simply cutting off sections of the lower rim (17) of the closure's skirt (111) to form crenels (22B), optionally separated by merlons (18B). In the embodiment depicted in FIG. 1(*b*), the merlon (18B) and crenels (22B) have substantially same height and width in the circumferential direction, but it is clear that they may have different dimensions.

Whether of same or different dimensions, the crenellation may have a maximum height comprised between 1 and 20 mm, preferably between 1.5 and 10 mm, more preferably between 2 and 4 mm. The at least one crenel (22B) may have a width in the circumferential direction comprised between 1.5 and 20 mm, preferably between 3 and 10 mm, more preferably between 4 and 8 mm and any merlon (18B), if any, has width comprised between 3 and 15 mm, preferably between 5 and 10 mm. The upper rim of the crenels may be straight as illustrated in FIG. 1, or may be curved, forming e.g., a rounded arch or an ogive.

A crenellated key system between the mouth of a container and the corresponding appliance is often found in the field of ink jet printers. Examples of such systems can be found in EP395197, EP1122078, and EP523915. In such systems, the outer wall of the neck section of an ink container is provided with a pattern of ribs and grooves matching the pattern in a receiving hole of the appliance. These key systems are meant for preventing an ink cartridge to be mounted onto a printer at a wrong position, corresponding to a colour different than the one contained in the cartridge, and are not at all meant for fixing the angular orientation in the axial direction of a container. Furthermore, the ink cartridges must be pressed into the mating opening to break open the sealed aperture, which is quite easy with a cartridge weighing a few hundreds of grams but is quite unthinkable with a 5 l container full of beer. The closure according to the present invention clearly differs from inkjet cartridge key systems in that the lower rim only of the closure is provided with a crenellation extending parallel to the skirt (111) of the closure, as it is to be laid onto a mating crenellation provided on the closure supporting means (22) of the dispensing appliance. The mouth of inkjet cartridges, on the other hand, must comprise a crenellation extending normal to the neck section of the container as it must be inserted and fit into substantially circular openings comprising a mating crenellation. The objective is also quite different, since the closure of the present invention serves to ensure that a pressure dispensing container is laid onto a dispensing appliance with the correct angular orientation, a, to fit a tube (15A) of the appliance (2) into a corresponding gas apertures (15B), which is offset with respect to the centroid of the closure base (110). The key portion in inkjet cartridges discussed above, on the other hand, are meant to prevent mounting a cartridge with the wrong colour into the printer.

The closure (8) of the present invention is mounted on a pressure dispensing container. As discussed above, pressure dispensing containers are not meant to dispense their liquid content by tilting the container until the mouth gets lower than the level of liquid contained therein. In other terms, the driving force for the flow is not gravity and dispensing is not dependent on the orientation of the container and may occur even with the container standing upright in a vertical position with its mouth at the highest position. The container (1) represented in FIGS. 2(*a*) and 3(*a*) is lying horizontally, which can be advantageous in case it is to be mounted on a dispensing appliance which is then placed into a cupboard or into conventional fridge. For technical reasons, the container must often be axisymmetrical, so that the angular orientation thereof when mounted onto an appliance must rely entirely on the crenellations of the closure (8) and the closure supporting means (22) of the appliance. If a non axisymmetric container can be used, than it could assist the crenellation system to further ease the correct angular positioning of the container into the appliance. For instance, the container may have a flat surface on the side of the closure crenellation. This embodiment, however, requires a careful orientation of the closure with respect to the container, which is not necessarily practical.

The container is preferably a bag-in-container comprising a flexible, collapsible inner bag (1B) contained in an outer container (1A), with an interface or gap (1C) between the two layers. Examples of bag-in-containers particularly suitable for the present invention are disclosed in EP2146832, EP2148770, EP2165968, EP2152494, EP2152486, EP2148771. The pressurized gas is to be injected through at least one vent communicating with the interface between inner and outer layers (1B, 1A), said vent being located adjacent to the mouth of the container and parallel to the axis of the container and is in fluid communication with the gas opening (15B) of the closure, which must therefore be located on the outer edge of the closure as illustrated in FIG. 1. A dispensing stem extending into the interior of the container is not necessary, since the collapse of the inner bag (1B) ensures that liquid is permanently in contact with the dispensing opening (10B) of the closure, regardless of the container orientation.

Traditional pressure dispensing containers wherein a pressurized gas is injected directly into the volume containing the liquid can also be provided with a closure according to the present invention. Such containers require a dispensing stem in fluid communication with the dispensing opening (10B) and extending into the interior of the container such that the opening of the stem located at the bottom of the container is permanently immersed in the liquid, to ensure proper dispensing even when the container is almost empty. The dispensing stem may be already provided in the closure, so that the same appliance as illustrated in FIG. 2 for bag-in-containers may be used. Alternatively, the dispensing stem must be inserted by the end user, which is less preferred as such operation is not straightforward. Regardless of the type of pressure dispensing container used, the liquid to be dispensed is preferably a beverage, in particular a carbonated beverage, preferably a soda or a beer.

In a preferred embodiment, the neck is provided with a ledge extending radially over part or the whole circumference of the neck, such that the lower rim (17) of the closure rests adjacent to, or even contacts, said ledge when the closure is in position on the container mouth. When the closure is in place, the ledge closes the open side of any crenel (22B) of the closure, thus defining a blind hole having a perimeter defined on one side by the ledge and for the rest of the perimeter by the geometry of the crenel, and its depth extends until the wall of the neck portion of the container. With such geometry, the accuracy of the engagement of the container in its proper angular orientation is further enhanced.

An embodiment of an appliance according to the present invention and suitable for receiving a container provided with a closure as discussed above is illustrated schematically in FIGS. 2&3. The side views in FIGS. 2(*d*) and 3(*d*) are represented with the container (1) mounted on the appliance. An appliance according to the present invention comprises (a) a holding portion (201) comprising means (21) for holding the body of said container, and means (22) suitable for receiving the closure (8) of the container (1), and (b) a dispensing portion (202) comprising a first tube (15A) suitable for engaging into said first offset opening (15B) of the closure (8), in fluid communication with the interior of the container.

Said dispensing portion (202) is movingly connected to the holding portion (201) to move from a first, loading position, allowing the loading of the container (1) onto the appliance (2), and a second, dispensing position, allowing the dispensing of the liquid contained in the container. The closure supporting means (22) comprise a crenellation comprising at least one merlon (22A) mating the crenellation of the closure (8).

In the embodiment represented in FIGS. 2 and 3, the dispensing portion (202) comprises two tubes (10A, 15A) as follows;

a gas tube (15A) suitable for engaging into said first offset opening (15B) of the closure (8), to bring in fluid communication the interior of the container with a source of pressurized gas (29), and a dispensing tube (10A) suitable for engaging into a second opening (10B) of the closure (8), to bring in fluid communication the volume containing the liquid with ambient It is clear that the dispensing portion (202) may comprise more than two tubes to be connected to more than two apertures of the closure (8), as long as the closure is not axisymmetric.

The dispensing portion (202) is movingly connected to the holding portion (201) to move from a first, loading position, allowing the loading of the container (1) onto the appliance (2), and a second, dispensing position, allowing the dispensing of the liquid contained in the container. The embodiment depicted in FIGS. 2&3 comprises rails for linearly moving the dispensing portion (202) from the first, loading position (cf. FIG. 2) to the second, dispensing position (cf. FIG. 3). Alternative embodiments are possible and the present invention is not restricted to any in particular. For instance, the dispensing portion (202) may be mounted on hinges permitting it to move from the first to the second position by rotation thereof about the hinges. Care must be taken in this embodiment to ensure that the trajectory of the dispensing tube (10A) and gas tube (15A) allows proper engagement thereof into the corresponding dispensing (10B) and gas (15B) openings of the closure (8).

The closure supporting means (22) of the appliance of the present invention comprise a crenellation comprising at least one merlon (22A) mating the at least one crenel (22B) of the closure (cf. FIG. 1(*a*)). The closure supporting means (22) illustrated in FIGS. 2 and 3 comprise two merlons (22A) and one crenel (18A) mating the at least one merlon (18B) and two crenels (22B) of the crenellation of the closure (8) illustrated in FIG. 1(*b*). More merlons (22A) and crenels (18A) may be provided in the closure supporting means as long as they mate the crenellation of the closure (8). Preferably, the edges of the crenellation of the appliance are chamfered such as to facilitate insertion of the merlons (22A, 18B) into the corresponding crenels (18A, 22B). The two crenellations need not necessarily comprise a mating merlon for each crenel, as long as at least one merlon mates a corresponding crenel to ensure that a single angular orientation is possible. For example, the absence of a merlon to mate an existing crenel does not jeopardize the constraint imposed by a mating merlon-crenel couple. It is, however, preferred that each crenel of one crenellation finds its mating merlon on the other crenellation.

The gas tube (15A) is connected to a source of pressurized gas (29) which can be a pump as illustrated in FIGS. 2&3, or any other means known in the art for pressurizing a gas or for storing a pressurized gas in a confined space, such as in a pressurized container or adsorbed on a support. The end of the gas tube (15A) must be sufficiently hard and sharp to perforate the gas opening (15B) which may be sealed in plant for hygienic reasons, by driving the dispensing (202) and support (201) portions of the appliance together into the second dispensing position. The dispensing tube (10A) is open to ambient at one end, with a valve (35) to control the flow of liquid out of the container. The other end of the dispensing tube must also be sufficiently hard and sharp to open the sealed dispensing opening (10B) when moving the dispensing portion from the first loading position to the second dispensing position (compare FIGS. 2&3).

The holding portion (201) comprises supporting means (22) for receiving and supporting the closure (8) of the container (1) and any other means (21) for holding the container firmly into position. In FIGS. 2&3, said means (21) are represented as a substantially half cylindrical cradle for holding the body of the container, but any other design can be applied and is not critical for the present invention. The holding portion (201) may be separatable in different parts to facilitate insertion of the container, or may be made of one piece, with an opening sufficiently large for allowing the introduction of the container onto the supporting means (21, 22). Whether the holding portion is separatable or not, and whether the two sections of the holding portion are fully separatable or connected by hinges or any other means is not critical and all these embodiments can be part of the present invention.

In the preferred embodiment illustrated in FIGS. 2 and 3, wherein the crenellation of the closure supporting means (22) of the appliance comprises at least one crenel (18A) surrounded by the at least two merlons (22A), a press button (23) may be provided at the bottom of the crenel (18A) and connected to a switch controlling the electrical circuit (28) of the appliance, for feeding e.g., a pump (29). Upon positioning the container with the correct angular position corresponding to the closure, with merlon (18B) snugly fitting in the crenel (18A) of the closure supporting means (22), the closure merlon (18B) presses the button (23) which closes the electrical circuit of the appliance and allows its activation. With this embodiment, it is not possible to activate the appliance if the container is not positioned with the correct angular orientation, a, as illustrated in FIGS. 2(*c*) and 3(*c*). Power may be supplied by the net, a battery or any other source of energy known to the person skilled in the art, such as a solar cell or a generator.

In another embodiment, the merlon (18B) of the closure may be provided with a bar code (112B), or any other identification system (112), and the crenel (18A) of the closure supporting means (22) may be provided with means for reading the information applied on the closure's merlon (18B), and a display in the front of the appliance may be provided to clearly identify the type of container and liquid contained therein which is mounted in the appliance. For example, it may identify the mark of a beer, nutritional information such as the alcohol content, sugar content, the year of fabrication, the date of consumption, and the like. Alternatively, the bar code (112B) can be provided at any fixed position on the closure's skirt (111) with respect to the at least one crenel (22B), which ensures that, when the container is properly loaded in the appliance, the bar code (112B) necessarily faces a bar code reader.

The invention claimed is:

1. A dispensing assembly comprising:

(a) a pressure driven dispensing container extending along an axial direction and comprising a body and an aperture closed by a closure, said closure comprising an outer shell comprising:

(i) a substantially planar base comprising a first outer main surface and a second inner main surface separated from the outer surface by the thickness of the base, said base further comprising a first aperture fluidly connecting the outer surface to the inner surface and being offset with respect to a centroid of the base, and (ii) an outer peripheral skirt jutting out of the periphery of the inner surface and forming a lower rim, said peripheral skirt being suitable for enclosing and for sealingly fixing the closure to the aperture of said pressure driven dispensing container; wherein the lower rim of the closure comprises a crenellation comprising at least one crenel; and (b) a dispensing appliance comprising:

(i) a holding portion comprising:

means for holding the body of said container, and means for receiving the closure of the container and comprising a crenellation comprising at least one merlon mating the crenellation of the closure, and (ii) a dispensing portion comprising a first tube suitable for engaging into said first offset opening of the closure, in fluid communication with the interior of the container, said dispensing portion being movingly connected to the holding portion to move from a first, loading position, allowing the loading of the container onto the appliance, and a second, dispensing position, allowing the dispensing of the liquid contained in the container, wherein, when the crenellation of the closure is engaged with the mating crenellation of the holding portion, the angular orientation of the container about its axial direction with respect to the dispensing appliance is such that the first tube faces said first offset opening of the closure and penetrates into the first offset opening upon moving said dispensing portion from the first, loading position, to the second, dispensing position.

2. The dispensing assembly according to claim 1, wherein the crenellation of the lower rim of the closure comprises at least two crenels separated by at least one merlon and the mating crenellation of the receiving portion comprises at least two protruding merlons separated by a recessed crenel.

3. The dispensing assembly according to claim 1, wherein the at least one merlon is provided with a bar code or any other means of information, comprising information related to the container and/or the liquid contained therein.

4. The dispensing assembly according to claim 1, wherein the closure further comprises sealing means and fixing means for sealingly fixing the closure to a pressure driven dispensing container.

5. The dispensing assembly according to claim 1, wherein the end of the first tube is sufficiently hard and sharp to penetrate into the first opening of the closure of a container when mounted onto the appliance with the crenellation of the closure engaged in the mating crenellation of the holding portion, upon moving the dispensing portion of the appliance into its second, dispensing position.

6. The dispensing assembly according to claim 1, wherein the container contains a beverage selected from wine, beer, soda, or another carbonated beverage.

7. The dispensing assembly according to claim 1, wherein the closure further comprises a second opening, and said dispensing portion further comprises a second tube suitable for engaging into said second opening of the closure, and wherein as the crenellation of the closure is engaged in the mating crenellation of the holding portion, the angular orientation of the container is such that said second tube faces said second opening and penetrates into the second opening upon moving said dispensing portion from the first, loading position, to the second, dispensing position bringing the interior of the container in fluid communication with ambient, whilst the first, offset tube is suitable for connecting the interior of the container to a source of pressurized gas.

8. The dispensing assembly according to claim 7, wherein in the dispensing position, the second tube brings the interior of the container in fluid communication with ambient, whilst the first, offset tube fluidly connects the interior of the container to a source of pressurized gas.

* * * * *